US010875172B2

(12) United States Patent
Reinhart

(10) Patent No.: US 10,875,172 B2
(45) Date of Patent: Dec. 29, 2020

(54) EXTENDED SAWHORSE WITH FOLDING SUPPORTS

(71) Applicant: Creative Plastic Concepts, LLC, Sycamore, OH (US)

(72) Inventor: Nickolas Reinhart, Findlay, OH (US)

(73) Assignee: CREATIVE PLASTIC CONCEPTS, LLC, Sycamore, OH (US)

( * ) Notice: Subject to any disclaimer, the term of this patent is extended or adjusted under 35 U.S.C. 154(b) by 413 days.

(21) Appl. No.: 15/482,030

(22) Filed: Apr. 7, 2017

(65) Prior Publication Data

US 2018/0290289 A1 Oct. 11, 2018

(51) Int. Cl.
*B25H 1/06* (2006.01)

(52) U.S. Cl.
CPC ..... *B25H 1/06* (2013.01)

(58) Field of Classification Search
CPC ..... B65H 1/06; B25H 1/06
USPC ..... 182/153, 183.1, 181.1
See application file for complete search history.

(56) References Cited

U.S. PATENT DOCUMENTS

| | | | | |
|---|---|---|---|---|
| 4,570,915 | A * | 2/1986 | O'Hern | B23D 57/0092 182/151 |
| 5,012,893 | A * | 5/1991 | Kraeger | B25H 1/06 182/153 |
| D392,746 | S | 3/1998 | Dickinson et al. | |
| 5,794,923 | A | 8/1998 | Bartlett | |
| D410,118 | S | 5/1999 | Bartlett | |
| D425,210 | S * | 5/2000 | DuRapau | D25/67 |
| 6,305,498 | B1 | 10/2001 | Itzkovitch | |
| 6,488,119 | B1 | 12/2002 | DuRapau et al. | |
| 6,712,180 | B2 | 3/2004 | Levy | |
| 7,021,424 | B2 | 4/2006 | Herman | |
| 8,757,322 | B2 * | 6/2014 | Peter | E04G 1/32 182/153 |
| D708,351 | S | 7/2014 | Ken-Dror et al. | |
| D721,442 | S | 1/2015 | Wang | |
| D722,183 | S | 2/2015 | Reinhart | |
| 2003/0051769 | A1 * | 3/2003 | Welsh | B25H 1/04 144/287 |
| 2010/0038332 | A1 * | 2/2010 | Ignatoff | B25H 1/06 211/201 |
| 2010/0084221 | A1 * | 4/2010 | Cuccio | B25H 1/06 182/129 |
| 2010/0288585 | A1 | 11/2010 | Katz et al. | |
| 2016/0221177 | A1 * | 8/2016 | Reinhart | B25H 1/06 |
| 2017/0173778 | A1 * | 6/2017 | Reinhart | B25H 1/06 |
| 2017/0312909 | A1 * | 11/2017 | Brunner | B25H 1/16 |
| 2018/0099403 | A1 * | 4/2018 | Reinhart | B25H 1/005 |

FOREIGN PATENT DOCUMENTS

| | | | | |
|---|---|---|---|---|
| GB | 2460173 | A * | 11/2009 | B25H 1/06 |

* cited by examiner

*Primary Examiner* — Alvin C Chin-Shue
(74) *Attorney, Agent, or Firm* — Jacob M. Ward; Ward Law Office LLC

(57) ABSTRACT

An extended sawhorse includes a first side body and a second side body. Each of the first side body and the second side body has second cross members that are integrally connected to outer leg portions and an inner leg portion of the side body. A pair of hinged folding platforms are rotatably coupled to the second cross members at connection areas directly adjacent the inner leg portion of each of the first side body and second side body.

17 Claims, 5 Drawing Sheets

EXTENDED SAWHORSE WITH FOLDING SUPPORTS

FIELD

The present disclosure generally relates to sawhorses and, more particularly, to a foldable extended sawhorse.

BACKGROUND

Sawhorses typically have fixed position legs and a flat, centrally positioned member, such as a two-by-four stud. These types of sawhorses are well known for supporting work during cutting and assembly operations. However, fixed orientation sawhorses have certain drawbacks, including a large footprint that makes storage and transportation of the sawhorses between worksites difficult. The use of construction materials such as lumber also adds significantly to the sawhorse weight. Moreover, the flat top of the centrally positioned member has certain disadvantages. Items placed on the sawhorse for work-related purposes can easily slide on such flat tops, causing costly mistakes and injuries.

A variety of folding sawhorses are also known. These sawhorses allow the legs to be moved between a stored position, having the legs abutting each other, to an extended position, having the legs spaced apart from each other. The foldability of the sawhorse resolves some of the drawbacks established above with respect to fixed position sawhorses. However, such folding sawhorses can suffer from instability, especially when the inner legs are not properly secured. This is especially a concern with folding sawhorses above a certain length, and having more than four legs in order to support the extended length.

There is a continuing need for an extended sawhorse that may be folded to a closed position for storage, but which also offers sufficient support and stability to the inner legs in an opened position. Desirably, the extended sawhorse will also have a top surface capable of gripping and stabilizing items placed between the extended sawhorse and another sawhorse.

SUMMARY

In concordance with the instant disclosure, an extended sawhorse that may be folded to a closed position for storage, but which also offers sufficient support and stability to the inner legs in an opened position, and which also has a top surface capable of gripping and stabilizing items placed between the extended sawhorse and another sawhorse, has been surprisingly discovered.

In one embodiment, an extended sawhorse includes a first side body and a second side body. The first side body is rotatably connected to the second side body between a closed position and an opened position. Each of the first side body and the second side body has a first cross member, a pair of second cross members, a pair of outer leg portions, and an inner leg portion. The outer leg portions are connected to the inner leg portion with the first cross member and the second cross members. The extended sawhorse further includes a pair of folding platforms. Each of the folding platforms is hingedly connected to one of the second cross members of the first side body and one of the second cross members of the second side body at connection areas directly adjacent to the inner leg portion. Advantageously, the extended sawhorse of the present disclosure stabilizes the inner legs portions, maximizing strength and stiffness thereof, through the use of the foldable platforms connected to the inner leg portions in this particular manner.

In a further embodiment, the first and second side body include a work support member containing at least one recess configured to hold a support beam. The support beam may be disposed in the recesses, and can also have multiple top indentations or slots to facilitate the formation of a work surface. A further stabilization of extended sawhorse may be further provided by the work support members in this manner.

DESCRIPTION OF THE DRAWINGS

The above, as well as other advantages of the present invention, will become clear to those skilled in the art from the following detailed description of a preferred embodiment when considered in the light of the accompanying drawings in which.

DETAILED DESCRIPTION

Figure 1:
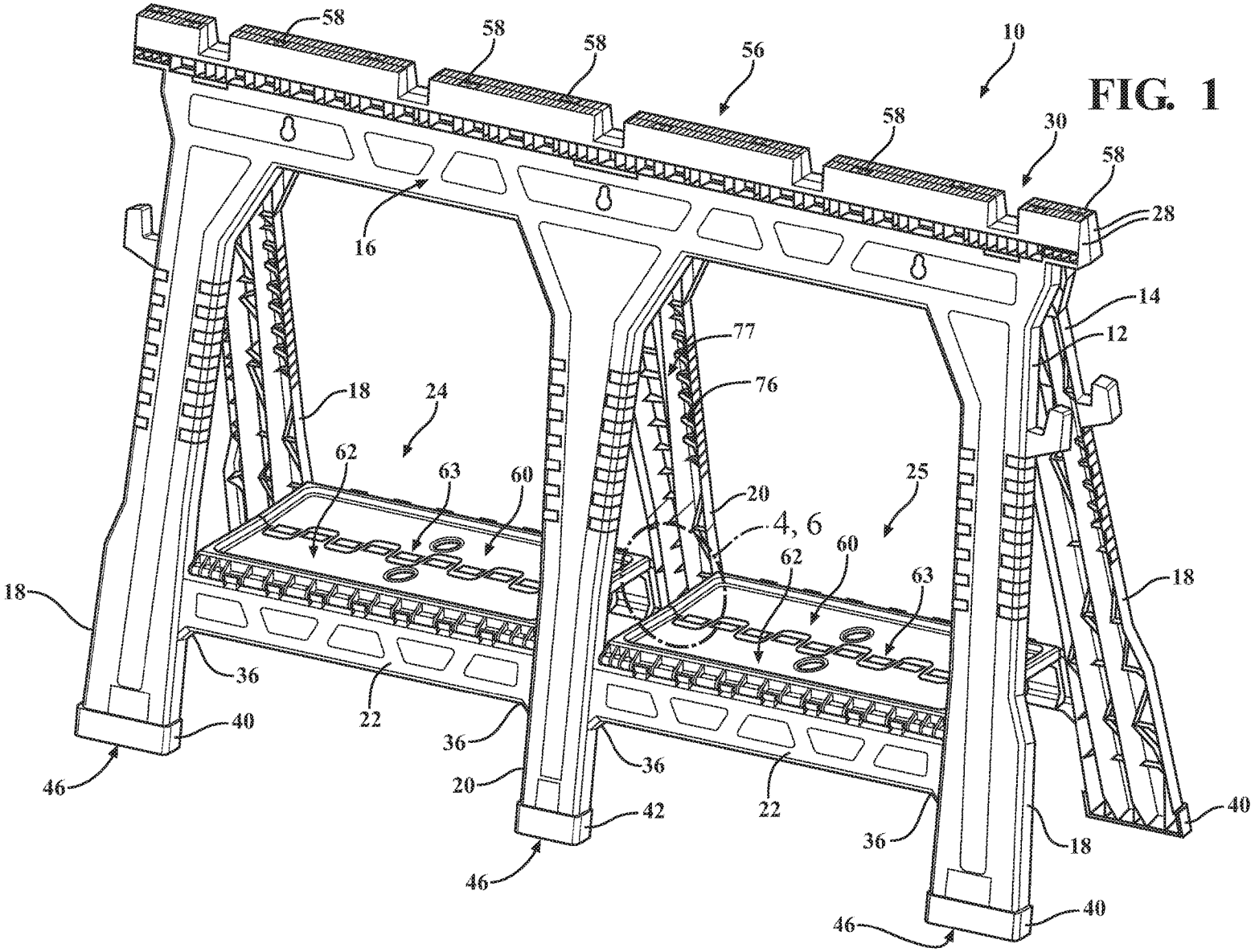
FIG. 1 is a top perspective view of an extended sawhorse according to one embodiment of the present disclosure, depicting the sawhorse in an opened position.

The following detailed description and appended drawings describe and illustrate various exemplary embodiments of the invention. The description and drawings serve to enable one skilled in the art to make and use the invention and are not intended to limit the scope of the invention in any manner. In respect of the methods disclosed, the steps presented are exemplary in nature and, thus, the order of the steps is not necessary or critical.

In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the related drawing. These relative terms are for convenience of description and do not require that the apparatus be constructed or operated in a particular orientation. Terms concerning attachments, such as "connected," "connecting," "coupled," and "coupling" are used interchangeably and refer to one structure or surface being secured to another structure or surface, unless expressly described otherwise.

Referring to FIGS. 1-6, an extended sawhorse 10 according to the present disclosure has a first side body 12 that is rotatably coupled to a second side body 14 between a closed position (not shown) for storage and transport, and an opened position (shown in FIG. 1) for end use. In the closed position, the lower extremities of the first side body 12 are arranged directly adjacent to, and in certain cases can abut, the lower extremities of the second side body 14. In the opened position, the lower extremities of the first side body 12 are spaced apart from the lower extremities of the second side body 14, so that the extended sawhorse 10 may be self-supporting and stand substantially upright on a floor surface.

It should be appreciated that the first side body 12 and the second side body 14 may be substantially mirror images of each other, which may facilitate a manufacturing of the extended sawhorse 10. The first side body 12 and the second side body 14 may be formed from a thermoplastic material, for example, using an injection molding process. One of ordinary skill in the art may also select other suitable materials and manufacturing processes for the first side body 12 and the second side body 14 of the extended sawhorse 10, as desired.

Each of the first side body 12 and the second side body 14 includes a first cross member 16 integrally connecting the top of outer leg portions 18 to the top of an inner leg portion 20. Each of the first side body 12 and the second side body 14 also include a second cross member 22 which is oriented substantially parallel to the first cross member 16. The second cross member 22 integrally connects the outer leg portions 18, to the inner leg portion 20 at connection areas 36.

As shown in FIG. 1, a pair of foldable platforms 24, 25 are coupled at four hinge areas to the second cross member 22 on both the first side body 12 and second side body 14. In the opened position, the folding platforms 24, 25 create a planar surface transversely positioned with respect to and connecting the second cross member 22 of each of the first side body 12 and the second side body 14. The folding platforms 24, 25 are folded into an inverted V-shape when the extended sawhorse 10 is placed in the closed position.

For additional stability, the bottom of each of the outer leg portions 18 is integrally connected to a molded foot 40. The inner leg portion 20 is also integrally connected to a molded foot 42 that may be narrower than the molded foot 40 of the outer leg portions 18. Each molded foot 40, 42 includes a face 46 that is configured to be oriented substantially parallel to the floor surface when the extended sawhorse 10 is in the opened position.

Additionally, each of the first cross members 16 of the first side body 12 and the second side body 14 include a work support member 28, which provides a substantially planar upper surface in the opened position. The work support members 28 can include singular, or multiple recesses 30 for supporting a variety of objects. Moreover, the recess 30 can be used to secure objects between two or more sawhorses 10.

Figure 2:
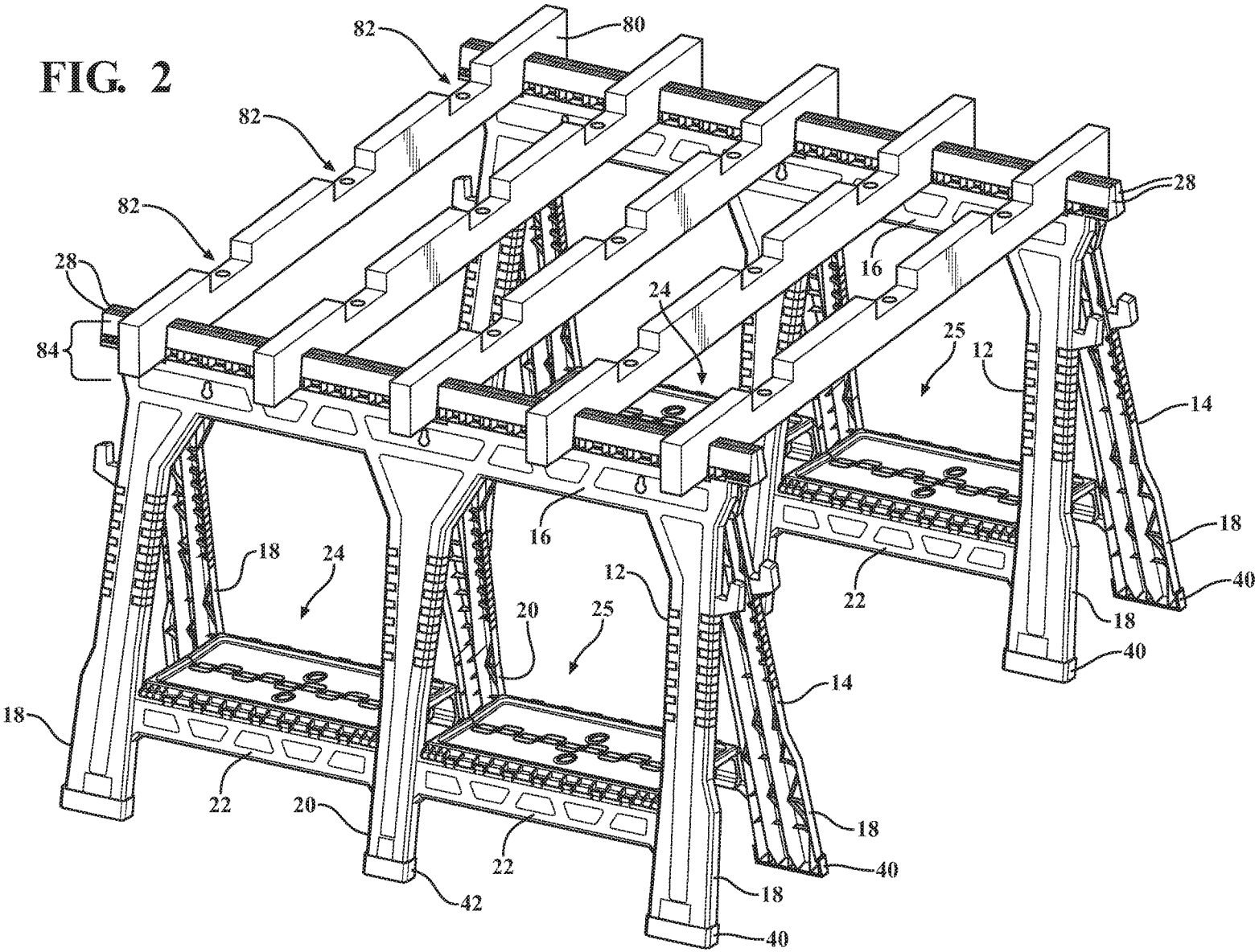
FIG. 2 is a top perspective view of a pair of the extended sawhorses shown in FIG. 1, with a plurality of support beams disposed therebetween, according to one embodiment of the present disclosure.

The work support member 28 may also have a plurality of spaced-apart raised ridges 56 created along a length of each of the work support members 28. The recesses 30 are formed between the spaced part ridges 56, for receiving support beams 80 as shown in FIG. 2. At least one, and in certain embodiments multiple ones of, friction pad 58 may also be fixed along the upper edge of the work support members 28, interspaced with the raised ridges 56. The friction pads 58 can be of a softer material, for example, a rubber material, to provide a gripping surface for work materials temporarily supported on extended sawhorse 10.

Multiple hinge members (not shown) may be used to rotatably connect the work support members 28 of the first side body 12 and second side body 14. The hinge members may be snapped together after separately molding the first side body 12 and the second side body 14, for example, to rotatably connect the first side body 12 to the second side body 14. Other means for rotatably connecting the first side body 12 and the second side body 14 of the extended sawhorse 10 may also be employed, as desired.

As shown in FIGS. 1-2, and 5-6, the folding platforms 24 and 25 each include a first shelf panel 60 and a second shelf panel 62. Advantageously, the first and second shelf panels 60, 62 may be provided as mirror image parts, for example, and thus be formed in a same mold. The two shelf panels 60, 62 are coupled together at hinge 63. The hinge members may be snapped together after separately molding the first shelf panel 60 and second shelf panel 62, for example, to rotatably connect at the hinge 63. Other means for rotatably connecting the first panels 60, to the second panel 62 may be employed within the scope of the disclosure.

Figure 4:
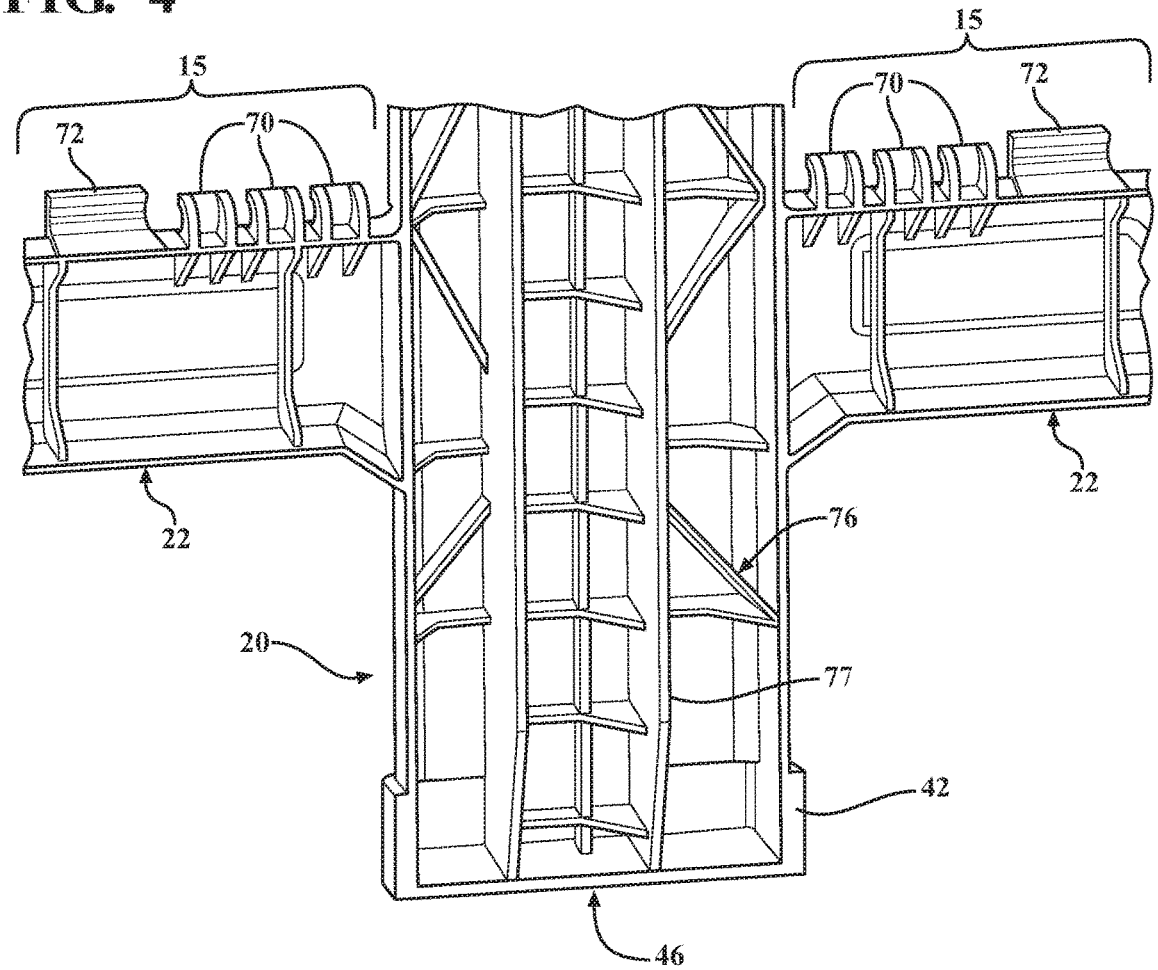
FIG. 4 is an enlarged fragmentary top perspective view taken at callout 4, 6 in FIG. 1, shown without the foldable platforms to illustrate connection areas of the second cross members coupled to and stabilizing the inner leg portion.
Figure 5:
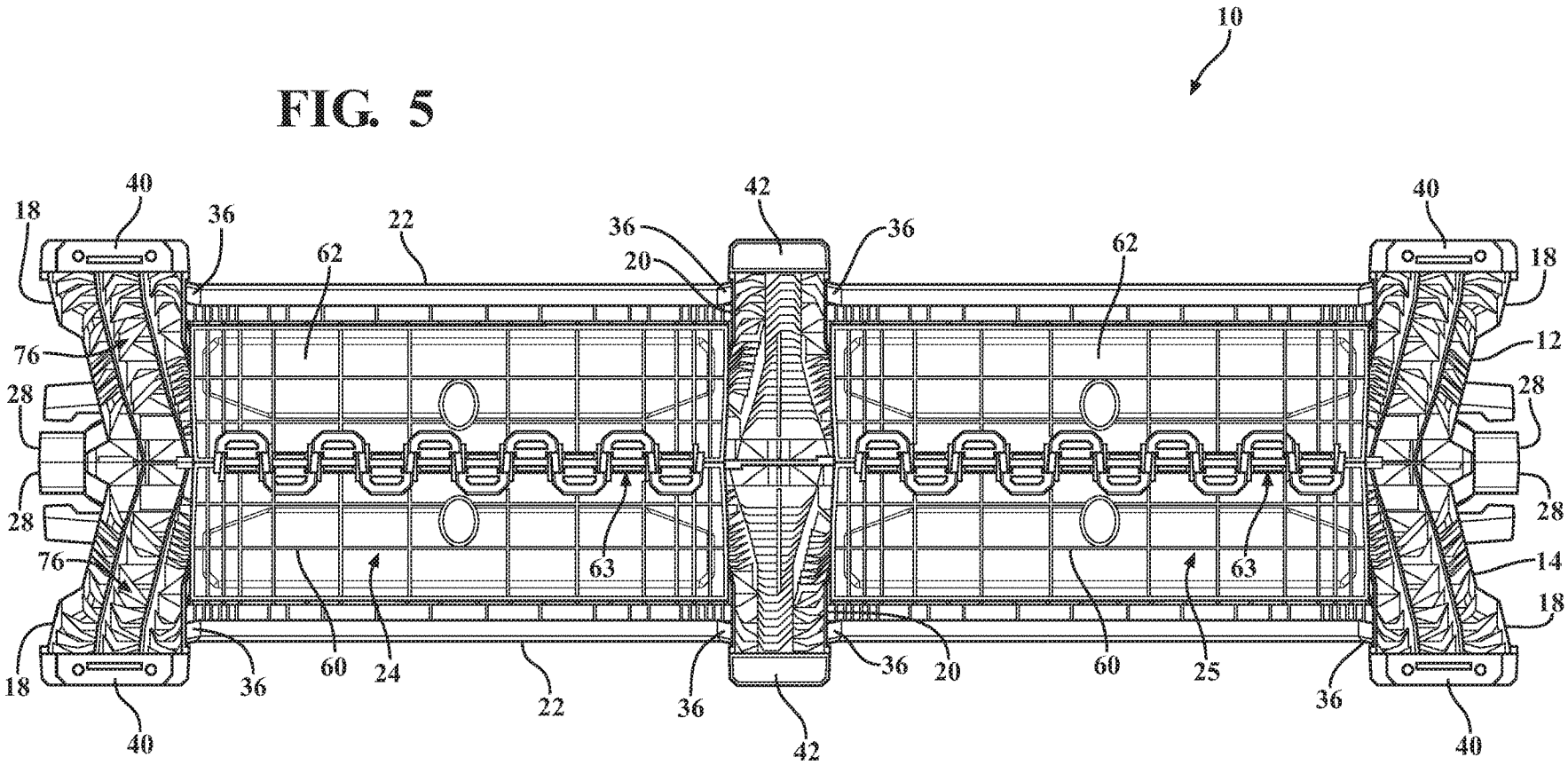
FIG. 5 is a bottom plan view of the extended sawhorse shown in FIG. 1, and further depicting the foldable platforms connecting to the second cross members adjacent to the inner leg portion.
Figure 6:
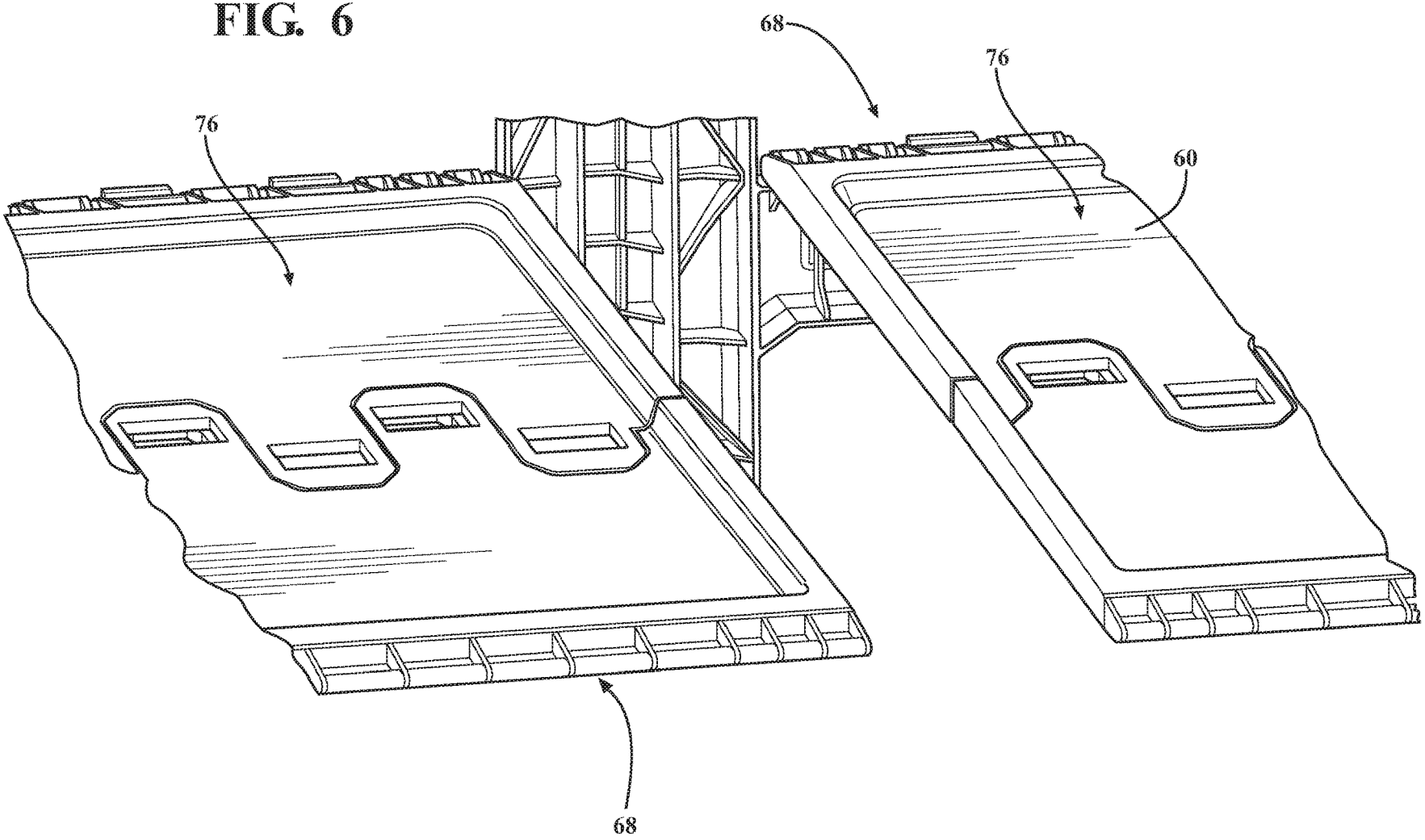
FIG. 6 is an enlarged fragmentary top perspective view taken at callout 4, 6 in FIG. 1, shown with the foldable platforms to illustrate a cooperation of the foldable platforms with the connection areas of the second cross members for further stabilizing the inner leg portion.

In addition, as shown in FIG. 6, each folding platform 24, 25 possess two hinge rods 68 that are configured to connect with the second cross member 22 on each of the first side body 12 and second side body 14. In particular, as shown in FIG. 4, the second cross member 22 of each of the first side body 12 and second side body 14 possesses a plurality of first knuckles 70 and a plurality of second knuckles 72. The first knuckles 70 and the second knuckles 72 are spaced apart and arranged directionally opposite one another on the upper surface of the second cross member 22, and are configured to receive the hinge rod 68 of the folding platforms 24, 25. The first knuckles 70 and the second knuckles 72 may also be arranged in an alternating fashion along at least a portion of the upper surface of the second cross member 22, to facilitate an insertion of the hinge rod 68 therebetween.

In a particular embodiment, the extended sawhorse 10, as shown in FIGS. 1-2 and 5-6, contains the folding platforms 24, 25 coupled to the second cross members 22 at a connection area 15 directly adjacent to the inner leg portion 20. At the connection area 15, the platforms 24 and 25 are coupled to the second cross member 22 by a hinge rod 68 disposed between three first knuckles 70 and a second knuckle 72, thereby rotatably joined with the second cross member 22 of the first side body 12. Likewise, the hinge rod 68 is rotatably coupled at connection area 15 on the second cross member 22 of the second side body 14 via cooperation with three first knuckles 70 and the second knuckle 72. The three first knuckles 70, disposed directly adjacent to the inner leg portion 20, provide additional support to the hinge rod 82 at connection area 15 and consequently increase the rigidity and stability of the inner leg portion 20.

Referring to FIG. 4, in order to minimize mass and molding material volume while also facilitating the stability of the inner leg portions 20, each of the first side body 12 and the second side body 14, and the first and second shelf panels 60, 62, may be hollow and provided with reinforcing ribs 76 formed on inner surfaces thereof. Each of the inner leg portions 20 may further includes elongate support elements 77. The elongate support elements 77 are oriented along the length of the inner leg portion 20. The reinforcing ribs 76 may further connect the elongate support elements 77 to an outer wall of the inner leg portion 20. These ribs 76 and elongate support elements 77 further add to the stability of the inner leg portions 20 while decreasing overall mass of the extended sawhorse 10.

FIG. 2 illustrates two of the extended sawhorses 10 connected by multiple support beams 80. Multiple extended sawhorses 10 and support beams 80 may be provided separately or in the form of a kit, for example, used to manufacture an extended sawhorse system onsite.

Figure 3:
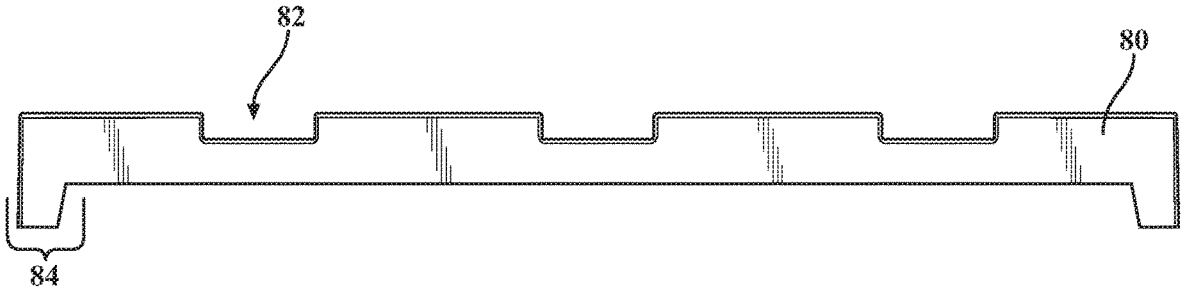
FIG. 3 is a side elevational view of one of the support beams shown in FIG. 2.

The support beams 80 have a top and bottom side. The top side of the support beams 80 contain multiple slots 82. The slots 82 are configured to hold a variety of items such as wood, pipes, metal and other similar items. Further, the bottom side of the support beam contains an extending portion 84 at each end. The extending portion 84 is configured to contact the work support members 28. The extending portions 84 may also have angled inner surfaces, as shown in FIG. 3, which facilitate an alignment and placing of the support beams 80 within the recesses 30 between the raised ridges 58 of the extended sawhorses 10.

In operation, two sawhorses 10 are placed adjacent to one another and, with the extending portions 84 facing down, the support beam 80 is hoisted into place to match the recess 30 in each opposite sawhorse. The support beam 80 is then secured to both of the extended sawhorses 10 when the beam 80 interlocks with the recess 30 while the extending portion 84 provides a stop to prevent slippage from the work support members 28. The use of multiple support beams 80 adds further stability and support to both of the extended sawhorses 10, as well as providing a work surface for end use.

While certain representative embodiments and details have been shown for purposes of illustrating the invention, it will be apparent to those skilled in the art that various changes may be made without departing from the scope of the disclosure, which is further described in the following appended claims.

The invention claimed is:

1. An extended sawhorse, comprising:

a first side body and a second side body, the first side body rotatably connected to the second side body between a closed position and an opened position, each of the first side body and the second side body having a first cross member, second cross members, outer leg portions, and an inner leg portion, each of the outer leg portions and the inner leg portion having a free end, each of the outer leg portions connected to the inner leg portion with the first cross member and the second cross members, and each of the second cross members being spaced apart from each of the free ends of the outer leg portions and inner leg portion; and a pair of folding platforms, each of the folding platforms hingedly connected to one of the second cross members of the first side body and one of the second cross members of the second side body at connection areas directly adjacent to the inner leg portion, each of the folding platforms having a centrally hinged folding joint, and each of the second cross members having a plurality of first knuckles at the connection areas and a plurality of oppositely arranged second knuckles spaced apart laterally from the plurality of first knuckles, and the pair of folding platforms being spaced apart laterally by the inner leg portion of each of the first side body and the second side body, wherein the inner leg portion of each of the first side body and the second side body has an outer wall defining a hollow interior, and the hollow interior contains elongate support elements and reinforcing ribs, the elongate support elements oriented along a length of the inner leg portion, the reinforcing ribs oriented transverse to the elongate support elements and connecting each of the elongate support elements to the outer wall of the inner leg portion, wherein each of the free ends of the outer leg portions and the inner leg portions has a foot with a face configured to be oriented substantially parallel to a floor surface when the extended sawhorse is in the opened position, wherein the foot of each of the outer leg portions is larger than the foot of each of the inner leg portions, wherein each of the first knuckles is disposed on top of one of the second cross members, the one of the second cross members further has an outer wall defining a hollow interior of the one of the second cross members, and each of the first knuckles is connected to the outer wall with an aligned support brace disposed in the hollow interior of the one of the second cross members.

2. The extended sawhorse of claim 1, wherein the each of the folding platforms has a hinge rod that is rotatably coupled to the first knuckles and the second knuckles on one of the second cross members.

3. The extended sawhorse of claim 1, wherein each of the connection areas includes three of the first knuckles and one of the second knuckles, the first knuckles disposed between the one of the second knuckles and the inner leg portion.

4. The extended sawhorse of claim 1, wherein there are four outer leg portions and two inner leg portions.

5. The extended sawhorse of claim 4, wherein the two inner leg portions are disposed between the four outer leg portions at a midpoint substantially equidistant from the four outer leg portions.

6. The extended sawhorse system of claim 1, wherein each of the elongate support elements and reinforcing ribs has a depth and a length, and the depth varies along the length of each of the elongate base supports and the reinforcing ribs.

7. The extended sawhorse system of claim 1, further comprising a support column disposed between the elongate support elements of the inner leg portion of one of the first side body and the second side body, and the support column oriented parallel with the elongate base supports.

8. An extended sawhorse, comprising:

a first side body and a second side body, the first side body rotatably connected to the second side body between a closed position and an opened position, each of the first side body and the second side body having a first cross member, second cross members, outer leg portions, and an inner leg portion, each of the outer leg portions and the inner leg portion having a free end, each of the outer leg portions connected to the inner leg portion with the first cross member and the second cross members, and each of the second cross members being spaced apart from each of the free ends of the outer leg portions and inner leg portion, wherein each of the second cross members has a plurality of first knuckles at the connection areas and a plurality of oppositely arranged second knuckles spaced apart laterally from the plurality of first knuckles, each of the connection areas includes three of the first knuckles and one of the second knuckle, the first knuckles disposed between the second knuckle and the inner leg portion, there are four outer leg portions and two inner leg portions, the two inner leg portions are disposed between the four outer leg portions at a midpoint substantially equidistant from the four outer leg portions, each of the first side body and the second side body are hollow and contain reinforcing ribs in the second cross members, the outer leg portions, and the inner leg portions, and each of the inner leg portions further includes elongate support elements oriented along the length of the inner leg portion, the reinforcing ribs connecting the elongate support elements to an outer wall of the inner leg portion; and a pair of folding platforms, each of the folding platforms hingedly connected to one of the second cross members of the first side body and one of the second cross members of the second side body at connection areas directly adjacent to the inner leg portion, wherein the each of the folding platforms has a hinge rod that is rotatably coupled the first knuckles and the second knuckles on one of the second cross members, each of the pair of folding platforms also having a centrally hinged folding joint, wherein the pair of folding platforms are spaced apart laterally by the inner leg portion of each of the first side body and the second side body, wherein the inner leg portion of each of the first side body and the second side body has an outer wall defining a hollow interior, and the hollow interior contains elongate support elements and reinforcing ribs, the elongate support elements oriented along a length of the inner leg portion, the reinforcing ribs oriented transverse to the elongate support elements and connecting each of the elongate support elements to the outer wall of the inner leg portion.

9. An extended sawhorse system, comprising:

a first extended sawhorse and a second extended sawhorse, each of the first extended sawhorse and the second extended sawhorse having a first side body and a second side body, the first side body rotatably connected to the second side body between a closed position and an opened position, each of the first side body and the second side body having a first cross member, second cross members, outer leg portions, and an inner leg portion, each of the outer leg portions and the inner leg portion having a free end, each of the outer leg portions connected to the inner leg portion with the first cross member and the second cross members, and each of the second cross members being spaced apart from each of the free ends of the outer leg portions and inner leg portion, and a pair of folding platforms, each of the folding platforms hingedly connected to one of the second cross members of the first side body and one of the second cross members of the second side body at connection areas directly adjacent to the inner leg portion, each of the pair of folding platforms also having a centrally hinged folding joint, wherein the pair of folding platforms are spaced apart laterally by the inner leg portion of each of the first side body and the second side body, wherein the inner leg portion of each of the first side body and the second side body has an outer wall defining a hollow interior, and the hollow interior contains elongate support elements and reinforcing ribs, the elongate support elements oriented along a length of the inner leg portion, the reinforcing ribs oriented transverse to the elongate support elements and connecting each of the elongate support elements to the outer wall of the inner leg portion, wherein each of the first extended sawhorse and the second extended sawhorse further has a work support member connected to the first cross member, the work support member having at least one recess; and at least one support beam connecting the first extended sawhorse and the second extended sawhorse, the support beam disposed in the recesses of the work support members of both of the first extended sawhorse and the second extended sawhorse.

10. The extended sawhorse system of claim 9, wherein at least one support beam has a top side and a bottom side, the top side having at least one slot formed therein.

11. The extended sawhorse system of claim 10, wherein the at least one support beam has an extending portion depending from the bottom side.

12. The extended sawhorse system of claim 11, wherein the extending portion has an angled inner surface.

13. The extended sawhorse system of claim 9, wherein each of the second cross members has a plurality of alternating and oppositely arranged first knuckles and second knuckles at the connection areas.

14. The extended sawhorse system of claim 13, wherein the each of the folding platforms has a hinge rod that is rotatably coupled the first knuckles and the second knuckles on one of the second cross members.

15. The extended sawhorse system of claim 13, wherein each of the connection areas includes three of the first knuckles and one of the second knuckle, the first knuckles disposed between the one of the second knuckles and the inner leg portion.

16. The extended sawhorse system of claim 9, wherein there are four outer leg portions and two inner leg portions.

17. The extended sawhorse system of claim 9, wherein each of the first side body and the second side body are hollow and contain reinforcing ribs in the second cross members, the outer leg portions, and the inner leg portions.

* * * * *